US007650842B2

(12) United States Patent
Reisch

(10) Patent No.: US 7,650,842 B2
(45) Date of Patent: Jan. 26, 2010

(54) DRIVING SYSTEM OF A SELF-DRIVING CABLEWAY CAR

(75) Inventor: Walter Reisch, Frastanz (AT)

(73) Assignee: Reisch Maschinenbau GmbH, Frastanz (AT)

( * ) Notice: Subject to any disclaimer, the term of this patent is extended or adjusted under 35 U.S.C. 154(b) by 0 days.

(21) Appl. No.: 11/905,471

(22) Filed: Oct. 1, 2007

(65) Prior Publication Data

US 2008/0078300 A1 Apr. 3, 2008

Related U.S. Application Data

(63) Continuation of application No. PCT/AT2006/000047, filed on Feb. 8, 2006.

(30) Foreign Application Priority Data

Apr. 1, 2005 (AT) ..... A 551/2005

(51) Int. Cl.
*B61B 7/00* (2006.01)
*B61B 12/12* (2006.01)

(52) U.S. Cl. ..... 104/112; 104/202

(58) Field of Classification Search ..... 104/112, 104/115, 117, 202–204
See application file for complete search history.

(56) References Cited

U.S. PATENT DOCUMENTS 2,834,302 A * 5/1958 Nixon ..... 105/148
3,448,694 A 6/1969 Seyfried (Continued)

FOREIGN PATENT DOCUMENTS

AT 263851 8/1968

(Continued)

OTHER PUBLICATIONS

International Search Report of Jul. 3, 2006 issued in the International Application No. PCT/AT2006/000047.

*Primary Examiner*—S. Joseph Morano
*Assistant Examiner*—Robert J McCarry, Jr
(74) *Attorney, Agent, or Firm*—Wenderoth, Lind & Ponack, L.L.P.

(57) ABSTRACT

A driving system of a self-driving cableway car includes on both sides of a vertical plane (8), in which the bearing cable (6) is located, driving chains (9, 10) that revolve about chain sprocket wheels (13, 14) with horizontal rotational axes (15, 16) The driving chains carry clamping units (31) with friction linings (35) for contacting the bearing cable (1), and lead rails (36, 37) disposed on opposite sides of the bearing cable. The clamping units (31) are guided during the revolution of the driving chains (9, 10) through a particular interspace (38, 39) between the bearing cable (6) and one of the lead rails (36, 37), and the friction linings (35) of the clamping units (31) are pressed onto the bearing cable (6) by rollers (33) rolling out on running faces (40, 41). Also, a particular lead rail (36, 37) is preloaded by a spring device (46) against clamping units (31) located in the interspace (38, 39) between this lead rail (36, 37) and the bearing cable (6). The rollers (33) are rotatably supported on the clamping units (31). The lead rails (36, 37) have the running faces (40, 41) on which roll out the rollers (33) of the clamping units (31) for pressing the friction linings (35) of the clamping units (31) onto the bearing cable (6).

15 Claims, 5 Drawing Sheets

U.S. PATENT DOCUMENTS

| | | | | | |
|---|---|---|---|---|---|
| 3,767,025 | A | * | 10/1973 | Louis | 198/867.05 |
| 5,103,738 | A | | 4/1992 | Claussen | |
| 5,634,407 | A | | 6/1997 | Niederer | |

FOREIGN PATENT DOCUMENTS

| | | |
|---|---|---|
| AT | 003 058 U1 | 9/1999 |
| CA | 1096368 | 2/1981 |
| CH | 462 225 | 10/1968 |
| DE | 23 54 767 | 5/1975 |
| DE | 202 13 353 | 11/2002 |
| GB | 146149 | 6/1921 |
| WO | 97/31809 | 9/1997 |
| WO | 2004/024527 | 3/2004 |

* cited by examiner

DRIVING SYSTEM OF A SELF-DRIVING CABLEWAY CAR

This is a Rule 1.53(b) Continuation of International Application No. CT/AT2006/000047, filed Feb. 8, 2006.

BACKGROUND OF THE INVENTION

1. Field of the Invention

The invention relates to a driving system of a self-driving cable cableway car which system comprises on both sides of a vertical plane, in which the bearing cable is disposed, driving chains revolving about chain sprocket wheels with horizontal rotational axes. The driving chains bear clamping units with friction linings for contact on the bearing cable, and lead rails disposed on opposite sides of the bearing cable. The clamping units, during the revolution of the driving chains, are guided through a particular interspace between the bearing cable and one of the lead rails and herein the friction linings of the clamping units are pressed onto the bearing cable by the rollers rolling out on running faces. Also, a particular lead rail is preloaded by a spring device against the particular clamping unit located in the interspace between the lead rail and the bearing cable.

2. Description of the Related Art

Although there is a multiplicity of proposals for implementing self-driving cableways, they have so far under conditions of practical requirements only been applicable to special applications, for example rescue cars. The economic application for cableway cars under continuous operation has so far not been possible. For such it must not only have high climbing ability and driving speed, it must have sufficient wear resistance. In addition, it is essential that the ratio of unladen weight to payload is not too high. For the climbing ability a value of at least 100% is conventionally required. For driving speed a value of at least 2 to 5 m/s is desired. Under utilization intensities customary for cableways, hundreds of operating hours and more are reached annually and appropriate wear resistance must be given. Acceptable weight ratios between tare and net weight should be better than three, and preferably better than two.

To attain sufficiently large friction faces between friction elements and bearing cable, crawler chain-like structures are conventionally utilized for self-driving cableways. Elastically lined friction elements are prescribed herein. To be able to generate sufficiently high forces for pressing the friction elements onto the bearing cable, the rollers, which roll out on corresponding running faces and press the friction elements onto the bearing cable, are implemented such that they are hardened, as are the running faces for the rollers.

Apart from an embodiment in which a single driving chain revolving in a vertical plane is provided, AT 263 851 also discloses an embodiment of a driving system of a self-driving cableway car, in which on both sides of the vertical plane in which the bearing cable is disposed, one driving chain revolves around chain sprocket wheels with horizontal axes. On the chain links are disposed clamping plates which are guided in the particular section of the driving chains adjacent to the bearing cable through a particular interspace between a driving rail and the bearing cable. On the clamping plates, with the interspacing of springs, rollers are pivoted which roll out on running faces of the lead rails, wherein the springs are compressed and the clamping plates are pressed onto the bearing cable. This system has the disadvantage of complicated implementations of the clamping units disposed on the driving chains. Each clamping unit requires a spring device which must exert sufficient compression force on the bearing cable and which, due to the continuous working movements, with each revolution of the chain is exposed to very high wear and therefore must be implemented with corresponding expenditures and complexities. Apart from the increased constructional expenditure, this leads in particular to relatively high unladen weight of the driving system and, consequently, of the entire cableway car which critically impairs the economy of the system.

In the driving system disclosed in CH 462 225 the clamping plates disposed on the chain links are loaded by stationary rollers under the action of springs, as is customary in track-laying trucks. The spring-loaded rollers press the clamping plates onto the bearing cable in the particular section of the chain located in the proximity of the rollers. The spring-loaded rollers must drive over the gap between the individual clamping plates. Due to this continuous driving over rail joints not only rough running results, but also high wear. Thereby only a relatively short service life is attained, in particular if the constructional expenditure and the weight are not supposed to be too high.

In the system of CA 1096368 A on the opposing sides of the bearing cable are provided driving chains disposed in a common plane. On the chain links are supported clamping plates which are pressed from above and below against the bearing cable. To exert pressure onto the clamping plates, again, as is known from crawler vehicles, a roller unit is provided. The rollers in this case are pivoted on separate chains which revolve about a carrier within the region encompassed by the driving chains. To clamp in the bearing cable between the opposing clamping plates, the carriers are pulled together by means of piston-cylinder units. In addition, a spring device is furthermore provided for exerting a prestress of the two carriers directed against one another. The apparatus expenditure of this device is substantially higher than in the cited constructions of AT 263 851 and CH 462 225 and the weight requirements for economic operation of a self-driving cableway car, in particular if such is to be employed as a means of transportation for persons, cannot even be approximately maintained. The rollers acted upon by the clamping plates, again, also drive over the joints between the clamping plates, which results in problems involving wear. Furthermore, in the region in which the clamping plates are pressed from above and from below onto the bearing cable, no bearing rollers of the cableway car roll out on the bearing cable such that a cableway car would only be realizable with a large overhanging construction.

A system of the type described in the introduction is disclosed in DE 202 13 353 U1. In the driving system disclosed in this document, the rollers, by means of which the friction linings of clamping units are pressed onto the bearing cable, are rotatably supported on U-profiles. The running faces, on which these rollers roll out, are disposed on the clamping units, which are carried by the chain links of the driving chains. During the revolution of the driving chains, the rollers drive over the joints between the individual clamping units, which results in rough running and high wear.

SUMMARY OF THE INVENTION

The present invention addresses the problem of providing an improved driving system of the type described in the introduction, with which sufficient climbing ability and driving speed can be achieved and which has high wear resistance and relatively low unladen weight.

According to the invention this is attained through a driving system of a self-driving cableway car comprising, on both sides of a vertical plane in which a bearing cable is located, driving chains revolving about chain sprocket wheels with horizontal rotational axes. The driving chains carry clamping units with friction linings for contacting on the bearing cable, and lead rails disposed on opposite sides of the bearing cable. The clamping units, during the revolution of the driving chains, are guided through a particular interspace between the bearing cable and one of the lead rails and the friction linings of the clamping units are pressed onto the bearing cable by rollers rolling out on running faces. A particular lead rail is preloaded by a spring device against particular clamping units located in the interspace between this lead rail and the bearing cable, and the rollers are rotatably supported on the clamping units. The lead rails comprise the running faces on which the rollers of the clamping units roll out for pressing the friction linings of the clamping units onto the bearing cable.

Essential characteristics of the system according to the invention are, in particular, that the rollers on the clamping units are pivoted and the lead rails are spring-loaded. The requisite compression forces of the clamping units on the bearing cable are generated by the spring device acting upon the lead rails. On the clamping units themselves therefore springs do not need to be provided, which must carry out continuous working movements with each revolution of the chain, and thereby considerable weight savings become possible. The rollers pivoted on the clamping units run out on joint-free continuous running faces of the lead rails. The wear of these rollers and of the running faces of the running rails can consequently be kept relatively low. The running faces of the rollers and of the running rails can be implemented such that they are hardened.

In an advantageous embodiment of the invention two or more brackets, spaced apart from one another in the longitudinal direction of the rails, engage on the lead rails. These brackets oppose one another pairwise and are implemented as single-arm levers and between which extend spring-loaded tension rods that pull the brackets about their rotational axes toward one another.

The clamping units are preferably supported in the link plates of the chain links such that they are displaceable and project on both sides beyond the chain. It is herein especially preferred that the two link plates have window cutouts through which a body of the particular clamping unit penetrates. A very simple and useful structure is herein attained, wherein tilting moments between the driving chain and the friction linings pressed onto the bearing cable can also be minimized. The chain bolts connecting the link plates and the friction linings of the clamping units, and preferably also the rollers of the clamping units, can favorably be disposed in a common plane.

Further advantages and details of the invention will be explained in the following in conjunction with the enclosed drawings.

DESCRIPTION OF THE PREFERRED EMBODIMENTS

Figure 1:
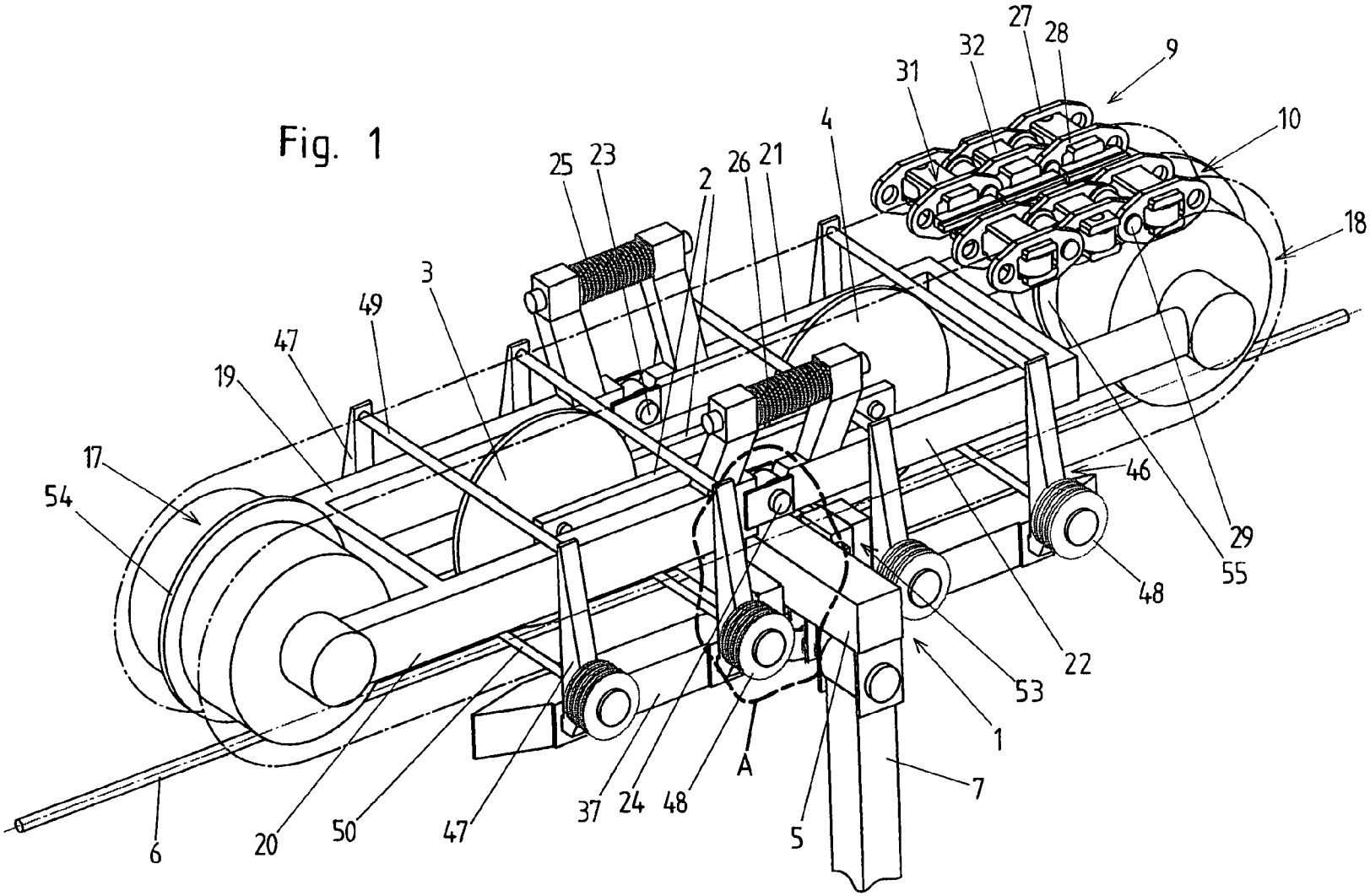
FIG. 1 is a perspective view of a simplified partially schematic diagram of an embodiment of the invention.

The Figures show an embodiment of the invention. A support frame 1 encompasses the longitudinal beams 2, on which the two central bearing rollers 3, 4 are rotatably supported, and a transverse beam 5 connects the longitudinal beams 2. The bearing rollers 3, 4 run out on the bearing cable 6.

Figure 2:
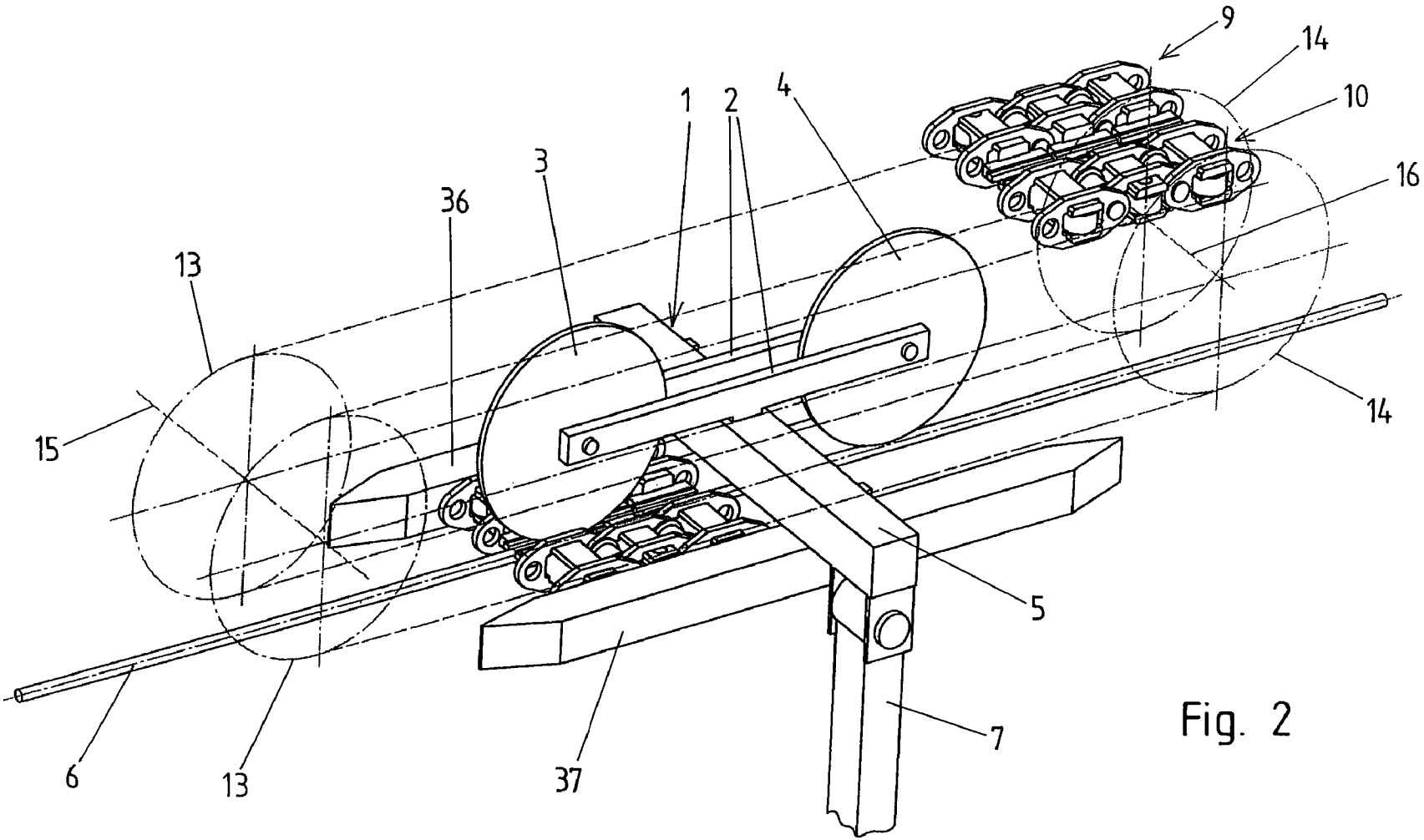
FIG. 2 is a diagram corresponding to FIG. 1, wherein parts of the driving system have been omitted for the purpose of clarifying the remaining elements.
Figure 6:
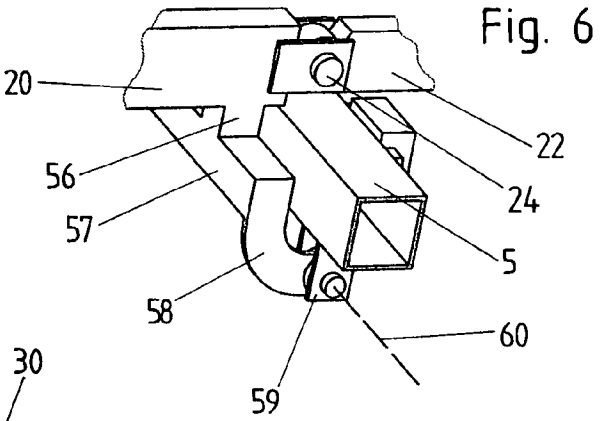
FIG. 6 is an enlarged perspective view of segment A from FIG. 1, with the front lead rail and its spring device having been omitted.
Figure 3:
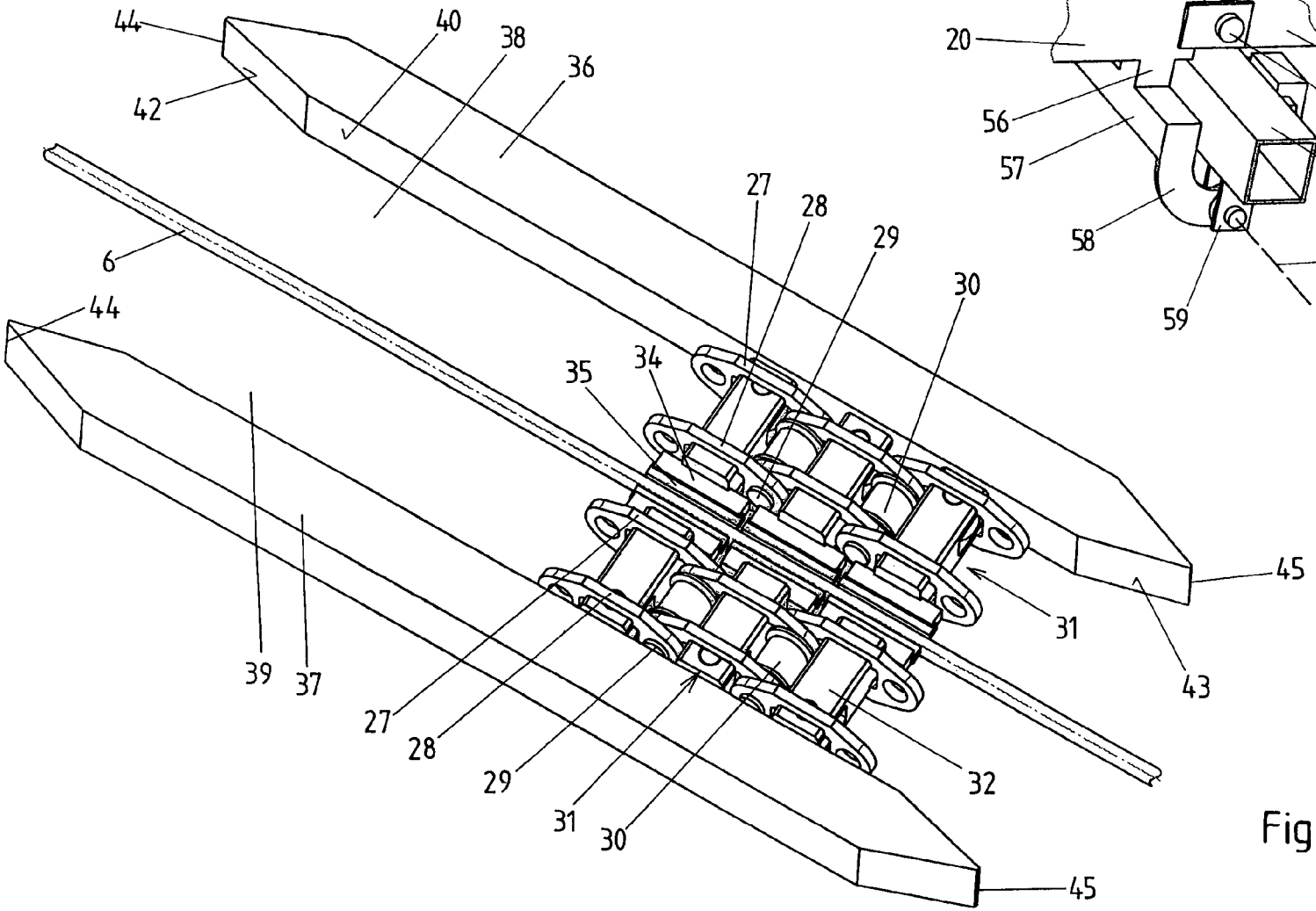
FIG. 3 is a perspective view of the lead rails, the bearing cable and sections of the interspaced chain strands of the driving chains, viewed from a slightly changed viewing direction.

A suspension tackle 7 is suspended from the support frame 1. As shown in FIGS. 1 and 2 only an upper arm of the suspension tackle is visible. The upper arm is articulated with the transverse beam and can encompass in particular a cableway cabin.

Figure 5:
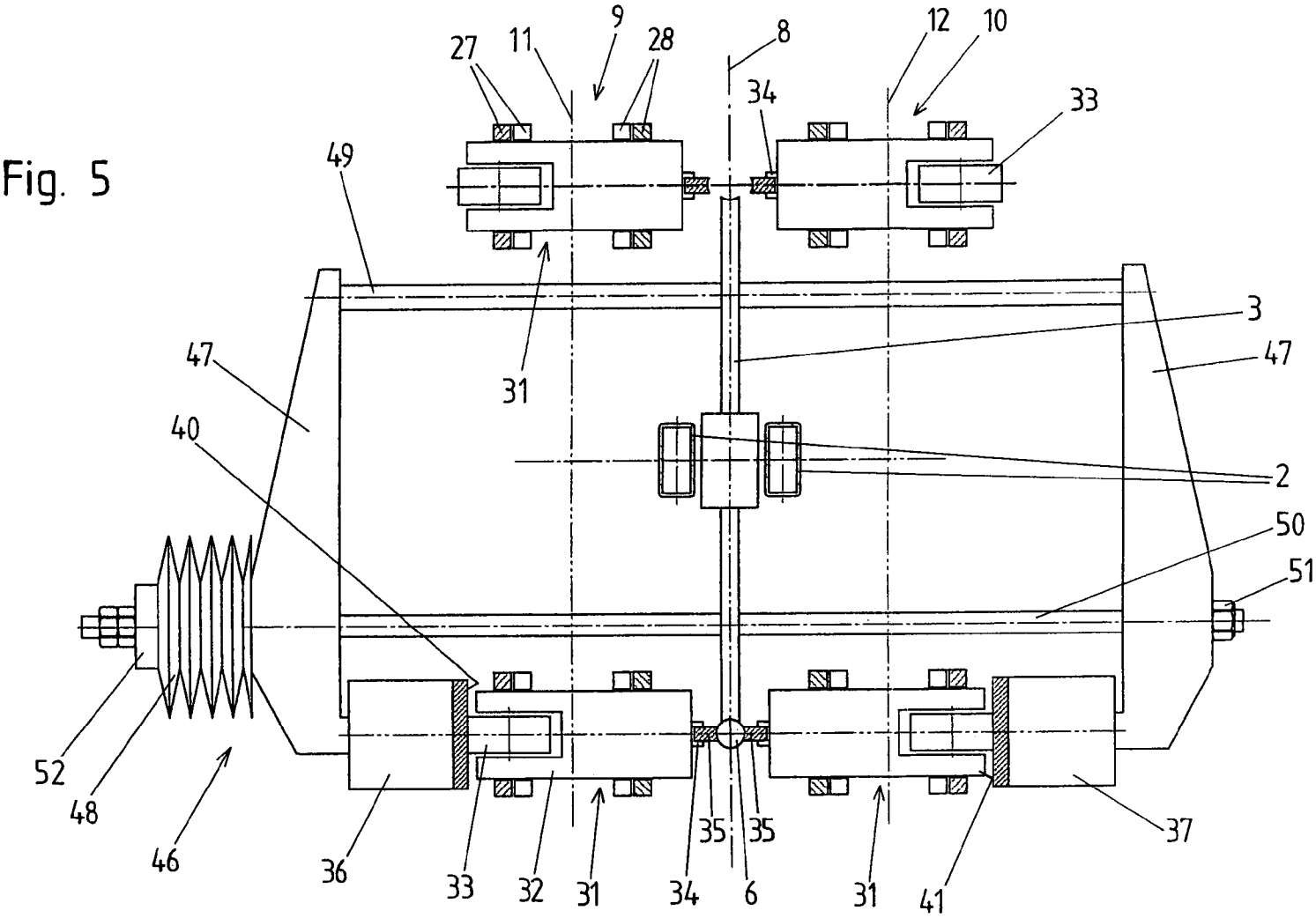
FIG. 5 is a simplified cross sectional view through one of the two central bearing rollers.

On both sides of the vertical plane 8 (see for example FIG. 5) in which is disposed the bearing cable 6, driving chains 9, 10 revolve in vertical planes 11, 12. Each of the driving chains 9, 10 revolves around first and second chain sprocket wheels 13, 14 represented in FIG. 2 only by dot-dash lines. The driving chains 9, 10 are only drawn section-wise in FIGS. 1 and 2 and their remaining course is indicated in dot-dash lines.

The two first chain sprocket wheels 13, like the two second chain sprocket wheels 14 are coaxial with respect to one another (the rotational axes 15, 16 are drawn in FIG. 2). The two chain sprocket wheels 13 are driven by a motor, which for the sake of simplicity is not shown in the figures, in order to propel the self-driving cableway car. This driving of the chain sprocket wheels 13 can be developed in conventional manner. The two chain sprocket wheels 14 are supported in a freely rotatable manner.

Additional bearing rollers 54, 55 are disposed between the two first chain sprocket wheels 14 and the two second chain sprocket wheels 13, respectively. The additional bearing rollers roll out on the bearing cable 6. The first chain sprocket wheels 13 with the interspaced bearing roller 54, like the second chain sprocket wheels 14 with the interspaced bearing roller 55, are preferably implemented as units 17, 18 rigidly connected with one another, which in FIG. 1 are only shown schematically for the sake of clarity. These units 17, 18 are rotatably supported on carriers 19, 20 and 21, 22, respectively, which via swivel connections 23, 24 are supported such that they are swivellable about a horizontal swivel axis at right angles to the bearing cable 6.

Springs 25, 26 engaging on carriers 19, 20 and 21, 22, respectively, (shown only schematically) act as tension and compression springs. If, starting from their parallel orientation, carriers 19, 20 and carriers 21, 22 are swivelled with respect to one another, the springs 25, 26 cause a reset force in the direction of this parallel orientation. Depending on the curvature of the bearing cable 6, loading or relief of the outer bearing rollers 54, 55 occurs, such that in each instance one portion of the weight of the cableway car is diverted via the bearing rollers 54, 55 onto the bearing cable 6. In the embodiment illustrated in FIG. 1, the springs 25, 26 act between two carriers 19, 21 and 20, 22, respectively, extending in opposite directions from the swivel connections 23, 24.

In this way a portion of the weight of the cable cableway car is transferred by the bearing rollers of units 17, 18 onto the bearing cable 6. The other portion of the weight is transferred onto the bearing cable 6 by the central bearing rollers 3, 4 located between these outer bearing rollers. The entire unit, which comprises the carriers 19 to 22, connected swivellably with one another, the springs 25, 26 acting between them, the chain sprocket wheels 13, 14 and the bearing rollers 54, 55 disposed between them, as well as the driving chains 9, 10 revolving about the chain sprocket wheels 13, 14, is swivelled on the support frame 1. For this purpose the carriers 19, 20 are rigidly connected with a transverse beam 57 via connection pieces 56. The transverse beam 57 comprises on both sides connection arms 58 which are articulated with connection plates 59 disposed on the transverse beam 5. This swivel axis 60 is located horizontally and at right angles to the bearing cable and in a plane in which is also disposed the bearing cable 6. Varying slopes of the bearing cable 6 have thereby no effects on the wheel loads of the bearing rollers 54 and 55.

It would also be conceivable and feasible to provide only such bearing rollers which are independent of the chain drive. The implementation of the bearing rollers and their bearing could in this case take place in a conventional manner.

The driving chains 9, 10 are implemented as link chains. A particular chain link comprises two link plates 27, 28 spaced apart from one another in the transverse direction, which are connected with one another via chain bolts 29. On the chain bolts are disposed chain rollers 30.

The driving chains 9, 10 carry clamping units 31. In the depicted embodiment each chain link carries one clamping unit 31, as is preferred.

Each clamping unit 31 is supported in the two link plates 27, 28 of a particular chain link such that it is displaceable and specifically in the direction at right angles to the bearing cable 6. The link plates have window cutouts through which penetrate the clamping units 31. The clamping units 31 project from the link plates 27, 28 on both sides of a particular driving chain 9, 10.

Each of the clamping units 31 comprises a body 32 on which, on the one hand, a roller 33 is rotatably supported and on which, on the other hand, a lining carrier 34 is fixed in place, which receives a friction lining 35 and secures it. The lining carriers 34 with the friction linings 35 are each disposed on the section of the body 32 projecting on the side of the bearing cable 6 from the link plates 28. Rollers 33 project on the side facing away from the bearing cable 6 beyond the particular link plate 27 and the front-side end of body 32.

The friction lining 35 of a particular clamping unit 31 and the link plates 27, 28 of the chain link bearing this clamping unit 31 are in a common plane. Roller 33 of the clamping unit is also located in this plane. This plane preferably penetrates the chain bolts 29 connecting the link plates 27, 28.

Each of the driving chains 9, 10 lies with a section in a common plane in which is also located the bearing cable 6. In the region of this section of the driving chains 9, 10 are located lead rails 36, 37 which are also located in the same plane. The lead rails 36, 37 extend on both sides at a distance from the bearing cable 6 and parallel thereto.

The particular sections of the driving chains 9, 10, which are in a common plane, in which the bearing cable 6 is also located, are guided through interspaces 38, 39 between the bearing cable 6 and the particular lead rail 36, 37. The clamping units 31 displaceably supported in the link plates 27, 28 of the chain links are consequently also guided by the driving chains 9, 10 through these interspaces 38, 39. The rollers 33 come to lie against the running faces 40, 41 of the lead rails 36, 37 and roll out along these running faces 40, 41. These running faces are consequently disposed on the sides of the lead rails 36, 37 facing the bearing cable 6.

Over the major portion of their length, the running faces 40, 41 extend so as to be parallel to the bearing cable 6. In the proximity of their two longitudinal ends, the running faces 40, 41 include sections 42, 43, in which their distance from the bearing cable 6 increases toward the particular free end 44, 45 of the lead rail 36, 37. These sections are formed by running-in bevels of the lead rails 36, 37.

The lead rails 36, 37 are preloaded through a spring device 46 against the clamping units 31, located in each instance in the interspaces 38, 39 between the lead rails 36, 37 and the bearing cable 6. The rollers 33 of such clamping units roll out on the running faces 40, 41. Thereby the required clamping force is generated with which the friction linings 35 are pressed from opposite sides onto the bearing cable 6.

Figure 4:
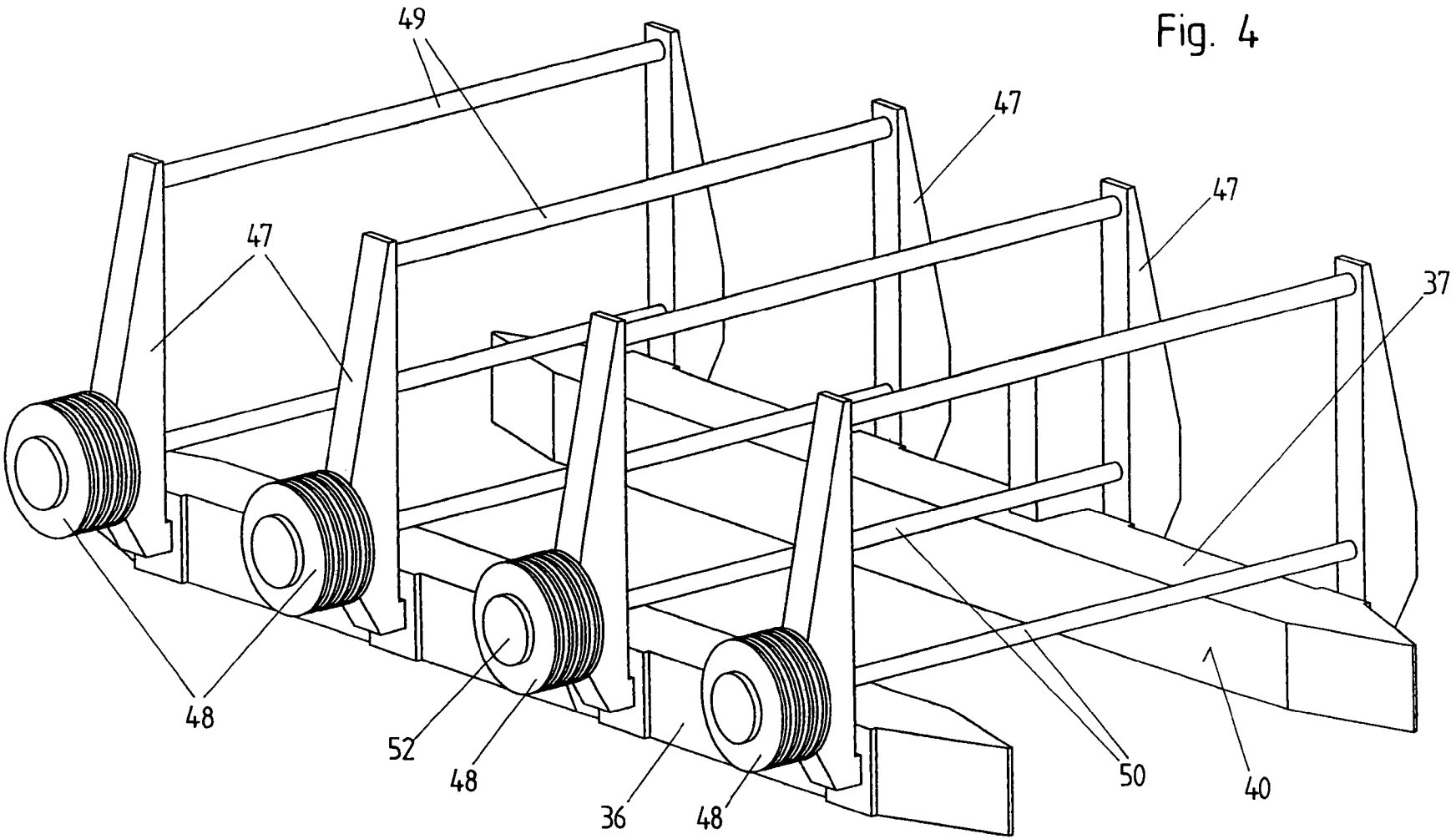
FIG. 4 is a perspective view of the lead rails and the spring device acting upon the lead rails, from a yet again different viewing direction.

As is evident in particular in FIG. 4 the spring device 46 comprises brackets 47 connected with the lead rails 36, 37, and the brackets engage on the outsides of the lead rails 36, 37 facing away from the bearing cable 6 and cooperate with the springs 48. With each lead rail 36, 37 are connected at least two brackets 47 spaced apart in the longitudinal direction of the lead rails 36, 37 (four are employed in the depicted embodiment). The brackets 47 of the two lead rails 36, 37 oppose one another pairwise and project upwardly from the lead rails 36, 37.

The brackets 47 act as single-armed levers, with compression rods 49 extending between them at the ends of the brackets 47 remote from the lead rails 36, 37. In the region between the compression rods 49 and the lead rails 36, preferably in the proximity of the lead rails 36, 37, tension rods 50 extend between opposing brackets 47 and penetrate the brackets 47 through bores. On the outside of one of the two opposing brackets 47, each of the tension rods 50 are braced for example via a nut 51 screwed onto an outer threading of the tension rod. On the outside of the other bracket 47, each tension rod 50 penetrates the spring 48 implemented in the depicted embodiment as a plate spring assembly and is stayed on its outside via a contact plate 52 which, for example, can be formed by an enlarged head of the tension rod 50.

Between the brackets 47 and the compression rods 49, articulations may be provided or the low swivel angles are derived from the elasticity of the material, as is shown schematically in FIG. 4. The same applies to the connections of the brackets 47 with the lead rails 36, 37.

The lead rails 36, 37 are supported on the support frame 1 such that they are displaceable in the transverse direction. A transverse guidance 53 on transverse beam 5 is indicated schematically in FIG. 1.

When the driving chains 9, 10 are driven by the motor (not shown), the clamping units 31 are guided by the driving chains 9, 10 through the interspaces 38, 39, wherein through the spring action of the lead rails 36, 37 against the rollers 33, rolling out on the running faces 40, 41 of the lead rails 36, 37, of the clamping units 31, the friction linings 35 are pressed onto the bearing cable 6. The driving chains 9, 10 are thereby via the clamping units 31 section-wise in frictional closure connection with the bearing cable 6, and thereby the cableway car is propelled.

To orient correctly (in the plane of the revolution of the chain and in the direction at right angles with respect to the bearing cable 6) the friction linings 35 of the clamping units 31 with respect to the bearing cable 6 during the running-in into the interspaces 38, 39 between the lead rails 36, 37 and the bearing cable 6, guide parts (not shown), for example rollers, are provided.

Furthermore, auxiliary devices (not shown) ensure that the clamping units 31 are in their opened position when driving over the chain sprocket wheels 13, 14.

The running faces 40, 41 of the lead rails 36, 37 are formed of hardened steel. The rollers 33 of the clamping units 31 are comprised of steel and are hardened at least in the proximity of their running faces.

The friction linings 35 are comprised of an elastic material. Consequently, only relatively low areal pressing can be introduced by the friction linings, such that overall a relatively large friction area is required which can be attained through the crawler-like structure.

In special cases, each of the clamping units 31 can include a spring acting between the roller 33 and the friction lining 35, whose spring force is greater than the proportion, acting onto the clamping unit 31, of the entire press-on force transmitted via the lead rails 36, 37 if the bearing cable has a constant diameter over the clamped region. Therefore, with such a constant diameter of the bearing cable 6, no compression of such springs (not shown) of the clamping units 31 occurs. Only if a local thickening of the bearing cable is present (for example through a hold-down or securement), whereby onto the clamping unit 31 pressed in the region of this thickening onto the bearing cable a significantly greater force acts, is this spring compressed and consequently acts as an overload safeguard.

Different modifications of the depicted embodiment are conceivable and feasible without departing from the scope of the invention. For example, it would be conceivable and feasible, although less preferred, to support the clamping units 31 displaceably not in window cutouts of the link plates 27, 28 but rather to suspend them from the link plates. The clamping units 31 in this case are continue to be guided through the interspaces 38, 39, while the driving chains 9, 10, however, in this case would extend above these interspaces 38, 39.

| Legend to the reference numbers | |
|---|---|
| 1 | Support frame |
| 2 | Longitudinal beam |
| 3 | Bearing roller |
| 4 | Bearing roller |
| 5 | Transverse beam |
| 6 | Bearing cable |
| 7 | Suspension tackle |
| 8 | Vertical plane |
| 9 | Driving chain |
| 10 | Driving chain |
| 11 | Vertical plane |
| 12 | Vertical plane |
| 13 | First chain sprocket wheel |
| 14 | Second chain sprocket wheel |
| 15 | Rotational axis |
| 16 | Rotational axis |
| 17 | Unit |
| 18 | Unit |
| 19 | Carrier |
| 20 | Carrier |
| 21 | Carrier |
| 22 | Carrier |
| 23 | Swivel connection |
| 24 | Swivel connection |
| 25 | Spring |
| 26 | Spring |
| 27 | Link plate |
| 28 | Link plate |
| 29 | Chain bolt |
| 30 | Chain roller |
| 31 | Clamping unit |
| 32 | Body |
| 33 | Roller |
| 34 | Lining carrier |
| 35 | Friction lining |
| 36 | Lead rail |
| 37 | Lead rail |

-continued

| Legend to the reference numbers | |
|---|---|
| 38 | Interspace |
| 39 | Interspace |
| 40 | Running face |
| 41 | Running face |
| 42 | Section |
| 43 | Section |
| 44 | Free end |
| 45 | Free end |
| 46 | Spring device |
| 47 | Bracket |
| 48 | Spring |
| 49 | Compression rod |
| 50 | Tension rod |
| 51 | Nut |
| 52 | Contact plate |
| 53 | Transverse guidance |
| 54 | Bearing roller |
| 55 | Bearing roller |
| 56 | Connection piece |
| 57 | Transverse beam |
| 58 | Connection arm |
| 59 | Connection plate |
| 60 | Swivel axis |

The invention claimed is:

1. A driving system of a self-driving cableway car, the driving system comprising:

driving chains disposed on both sides of a vertical plane in which a bearing cable is located, each of the driving chains comprising a plurality of chain links and revolving about chain sprocket wheels having horizontal rotational axes, each of the chain links including first and second link plates connected by chain bolts;

a plurality of clamping units carried by the chain links, respectively, each of the clamping units including a roller rotatably supported in the clamping unit, and a friction lining for contacting the bearing cable, wherein each of the clamping units is supported in the first and second link plates of the respective chain link and is displaceable relative to the first and second link plates by penetrating window cut outs in the first and second link plates of the chain link; and lead rails disposed on opposite sides of the bearing cable, each of the lead rails having running faces for the rollers of the clamping units; and a spring device preloading the lead rails, wherein the clamping units, during the revolution of the driving chains, are guided through interspaces formed between the bearing cable and the lead rails, and the friction linings of the clamping units are pressed onto the bearing cable by the rollers rolling out on the running faces of the lead rails which are preloaded by the spring device against the clamping units located in the interspaces between the lead rail and the bearing cable.

2. The driving system as claimed in claim 1, wherein the spring device comprises brackets connected with the lead rails, which are acted upon by springs.

3. The driving system as claimed in claim 2, wherein with each of the lead rails are connected at least two brackets spaced apart from one another in the longitudinal direction of the lead rails, wherein the brackets pairwise oppose one another, and the opposing brackets are connected with one another via tension rods that are acted upon by springs.

4. The driving system as claimed in claim 2, wherein the brackets are implemented as single-armed levers.

5. The driving system as claimed in claim 4, wherein ends remote from the lead rails of opposing brackets are spaced apart from one another by compression rods.

6. The driving system as claimed in claim 1, wherein the lead rails are supported on a support frame such that they are displaceable transversely relative to the bearing cable.

7. The driving system as claimed in claim 1, wherein for each of the clamping units, the friction lining and the roller as well as the link plate of the respective chain link supporting the clamping unit are located in a common plane.

8. The driving system as claimed in claim 7, wherein in each of the clamping units, the chain bolts connecting the link plates are located in a common plane with the friction lining and the roller of the clamping unit.

9. The driving system as claimed in claim 1, wherein the first chain sprocket wheels of the driving chains are disposed coaxially with respect to one another and, between the first chain sprocket wheels, a first bearing roller is disposed coaxially with respect to the first chain sprocket wheels and to roll out on the bearing cable, and wherein the second chain sprocket wheels of the driving chains are coaxial with respect to one another and, between the second chain sprocket wheels, a second bearing roller is disposed coaxially with respect to the second chain sprocket wheels and to roll out on the bearing cable.

10. The driving system as claimed in claim 9, wherein the first chain sprocket wheels and the first bearing roller disposed between them define a first rigidly connected unit, and the second chain sprocket wheels and the second bearing roller disposed between them define a second rigidly connected unit.

11. The driving system as claimed in claim 9, wherein the first chain sprocket wheels and the first bearing roller between them, and the second chain sprocket wheels and the second bearing roller between them are supported on carriers that are swivellable about a horizontal axis at right angles to the bearing cable.

12. The driving system as claimed in claim 11, further comprising springs acting between the carriers carrying the first bearing roller and the carriers carrying the second bearing roller, wherein, upon a swivelling of the carriers from their parallel orientation, the springs exert a reset force into a parallel orientation.

13. The driving system as claimed in claim 12, wherein the springs act between the carriers, connected swivellably with one another, of the first and second bearing rollers.

14. The driving system as claimed in claim 12, wherein the entire unit comprising the carriers is connected swivelably with respect to the support frame, and specifically about a horizontal swivel axis at a right angle to the bearing cable, the horizontal swivel axis is located in a plane extending through the bearing cable.

15. The driving system as claimed in claim 9, wherein central bearing rollers are rotatably supported on the support frame in the region between these bearing rollers.

* * * * *